US005335533A

United States Patent [19]

Rehus

[11] Patent Number: 5,335,533

[45] Date of Patent: Aug. 9, 1994

[54] PULL CLAMPS FOR STRAIGHTENING AUTOMOBILE UNDERFRAMES AND DOOR HINGE PILLARS, AND THEIR USE

[76] Inventor: Tommy L. Rehus, 2814 Esturion Ct., Carlsbad, Calif. 92009

[21] Appl. No.: 73,718

[22] Filed: Jun. 8, 1993

[51] Int. Cl.[5] ..... B21D 1/12

[52] U.S. Cl. ..... 72/422; 72/705

[58] Field of Search ..... 72/308, 422, 457, 705

[56] References Cited

U.S. PATENT DOCUMENTS

| | | | |
|---|---|---|---|
| 4,248,078 | 2/1981 | Russo | 72/705 |
| 4,848,130 | 7/1989 | Jimenez | 72/705 |
| 5,044,191 | 9/1991 | Combs | 72/705 |

OTHER PUBLICATIONS

Catalog of Keysco Tools, pp. 10–11 (1990).
Catalog of Tools USA, pp. 11–18 (1991).
Catalog of Pull-It Corporation, "The Original Mo-Clamp", entire catalog (1991).
Catalog of Tools USA, pp. 11–15 (1992).
Catalog 87 of California Tool Co., pp. 638, 638–633, and 638–639 (date unknown).
Catalog of Mac Tools, pp. 385–386 (date unknown).
Catalog All of H. K. Porter, Inc., p. 15 (date unknown).

*Primary Examiner*—Lowell A. Larson
*Attorney, Agent, or Firm*—Gregory Garmong

[57] ABSTRACT

A universal pull clamp includes multiple attachment points and slots. The clamp may be attached to any of a variety of types of damaged automobile frames and locations during their repair. Once the clamp is attached, straightening is accomplished by pulling on the clamp with an external force to return the frame back to its original shape. In one form, the clamp uses a sliding bar and channel arrangement. In another form, the clamp uses a pivoting arrangement.

16 Claims, 3 Drawing Sheets

PULL CLAMPS FOR STRAIGHTENING AUTOMOBILE UNDERFRAMES AND DOOR HINGE PILLARS, AND THEIR USE

BACKGROUND OF THE INVENTION

This invention relates to the straightening of damaged automobile underframes and door hinge pillars, and, more particularly, to pull clamps that attach to the frame structure of the automobile.

Automobile accidents produce damage of varying severity to the involved vehicles. In a relatively minor automobile accident of the "fenderbender" type, only the bodywork of the automobile is damaged. The automobile is repaired by replacing the damaged bodywork panels.

In more severe accidents, all or part of the frame of the automobile can be bent, in addition to the damage to the bodywork panels. To repair a bent frame, an external frame straightening puller is attached to the frame using a pull clamp. A sufficiently large pulling force is applied by the external puller to the pull clamp and thence to the frame, so that the frame is straightened back to its original form. Since the frame may be bent in a complex fashion, the straightening process usually involves an incremental series of attachments and straightening pulls at different locations of the frame. Once the frame is straightened, new bodywork panels and other components are attached to the frame to complete the repair.

Automobile manufacturers provide holes in the frame members of their products for assembly of the automobile, and also in anticipation of the need to attach a pull clamp during repair. For example, the door hinges of most automobiles are attached with bolts using a hole pattern on the door hinge pillar. When the door hinge pillar is to be straightened, the door hinge can be removed and a pull clamp attached through this hole pattern. In another example, the primary body underframe of an automobile having a unibody welded construction may have holes positioned in frame members primarily for use in straightening operations.

One of the problems faced by automotive repair services who perform frame straightening is that there are no standard patterns of attachment holes in automotive frames. For example, the patterns of holes in General Motors frames is typically different from that in Ford frames. Also, there are different arrangements of holes in various parts of the frames of even the same manufacturer. The hole patterns may also vary from year-to-year in the models of the same manufacturer.

Frame straightening repair services must therefore purchase multiple sets (sometimes termed "tool boards") of pull clamps that are operable for various hole patterns. Both a "General Motors Tool Board" and a "Ford Tool Board" would be purchased, as well as tool sets for other automobile manufacturers. An alternative to this expensive outlay is to jury rig pull clamps, which can lead to ineffective straightening procedures.

Another alternative is the use of pull clamps with multiple attachment hole configurations. Such pull clamps are typically in the form of a plate with multiple holes therein. The frame straightener attempts to find sets of holes in the plate that register with those of the frame. If such a registry can be found, the plate is attached through those holes, and the straightening force is applied by attachment to another location on the plate. This approach has limited effectiveness, because it is often difficult to find a registered pattern and because it is difficult to apply the straightening force in precisely the desired direction.

There is therefore a need for an improved approach to pull clamps for frame straightening of automobiles. The present invention fulfills this need, and further provides related advantages.

SUMMARY OF THE INVENTION

The present invention provides adjustable pull clamps used to straighten automobile frames. These pull clamps can be attached to a wide range of hole patterns in the frame of an automobile by bolts. A pulling force is applied through the pull clamp to the frame, during frame straightening. These pull clamps reduce the numbers of different types of pull clamps that a frame straightening service must maintain. They also improve the accuracy of frame straightening procedures by increasing the range of available pulling angles and forces that can be used. The pull clamps are readily attached and removed from the frame, to permit the many incremental pulls often required in the straightening process.

In accordance with one embodiment of the invention, an auto frame pull clamp comprises a first elongated member having an elongated first member body, a slot in the first member body extending parallel to the direction of elongation of the first member body, and a threaded hole at a first end of the first member body. A second elongated member has an elongated second member body having a bore therethrough at one end thereof, a threaded hole in the second elongated member, the threaded hole being in registry with the slot in the first member body, and at least one bore through a second end of the second member body disposed oppositely to the first end of the first member body. There is further a means for retaining the first elongated member and the second elongated member in sliding contact.

This pull clamp is of most use in attachment to the body underframes of the automobiles. These body underframes typically have aligned pairs of holes. The first member body is attached to one of the pairs of holes in the underframe through its threaded hole. The second member body is telescoped by sliding it along the first member body until the threaded hole in the second member body aligns with another hole in the underframe. A bolt is connected through the hole in the underframe and the slot in the first member body to the threaded hole in the second member body. The pull clamp is thereby firmly anchored to the underframe. A clevis or other attachement is made from the external frame straightening puller to the bore in the second member, and straightening proceeds.

In another embodiment of the invention, an auto frame pull clamp comprises a U-shaped body having a base leg and two side legs, the base leg having a longitudinal direction parallel to the side legs and a transverse direction perpendicular to the side legs. The U-shaped body further comprises at least one pair of pivot bores in the side legs, with each pair of pivot bores including a facing pivot bore in each of the side legs. There is at least one longitudinal slot in the base leg oriented parallel to the longitudinal direction, and at least one transverse slot in the base leg oriented parallel to the transverse direction. Preferably, there are multiple longitudinal and transverse slots. The pull clamp further includes a pivoting member, comprising a hollow cylindrical pivot having a length less than a spacing between the side legs of the U-shaped body, and a tongue member joined to the cylindrical pivot. The tongue member has a slot extending perpendicular to a cylindrical axis of the cylindrical pivot. An axle is sized to rotatably join the cylindrical pivot of the pivoting member to the U-shaped body by passing through the at least one pair of pivot bores.

This form of adjustable pull clamp is of particular use in attachment to door hinge pillars and the like. The slots permit attachment of the U-shaped body to various arrangements of hole patterns in the door hinge pillar portion of the frame. The pivoting tongue allows the pulling force to be exerted at any desired angle away from the door hinge pillar to straighten the door hinge pillar or other portion of the structure. The slot in the tongue member can be oriented asymmetrically to provide even more flexibility in the direction and nature of the applied pulling force.

The adjustable pull clamps of the invention provide an important advance in the art of automobile frame straightening. These pull clamps allow attachment of external frame straightening pullers to various hole patterns, and the application of the pulling force in a variety of directions. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
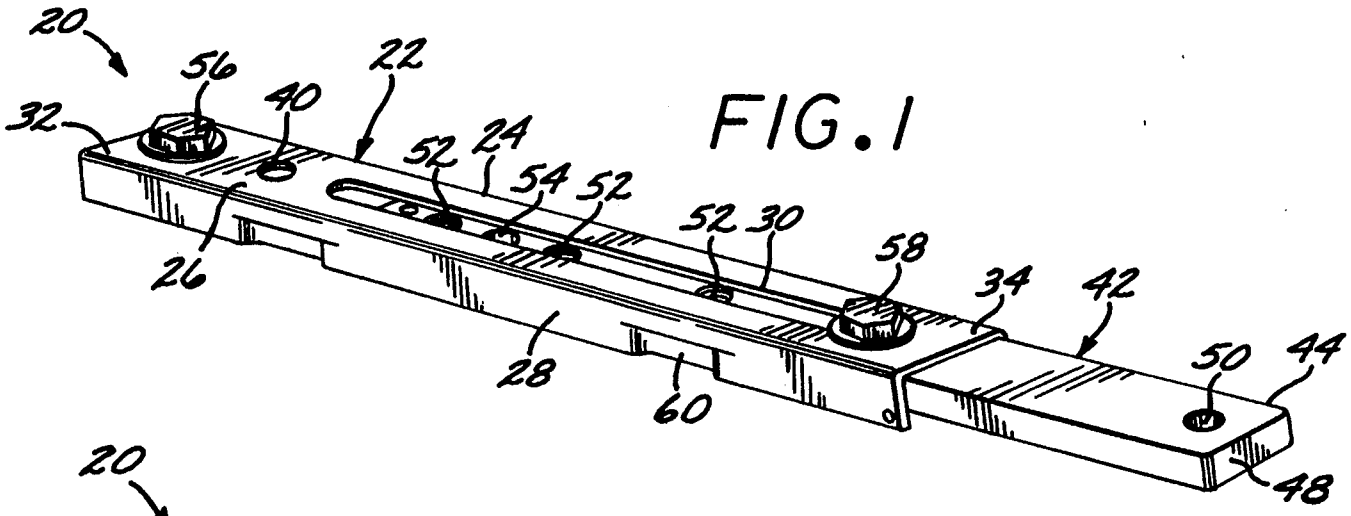
FIG. 1 is a top perspective view of an underframe pull clamp.
Figure 2:
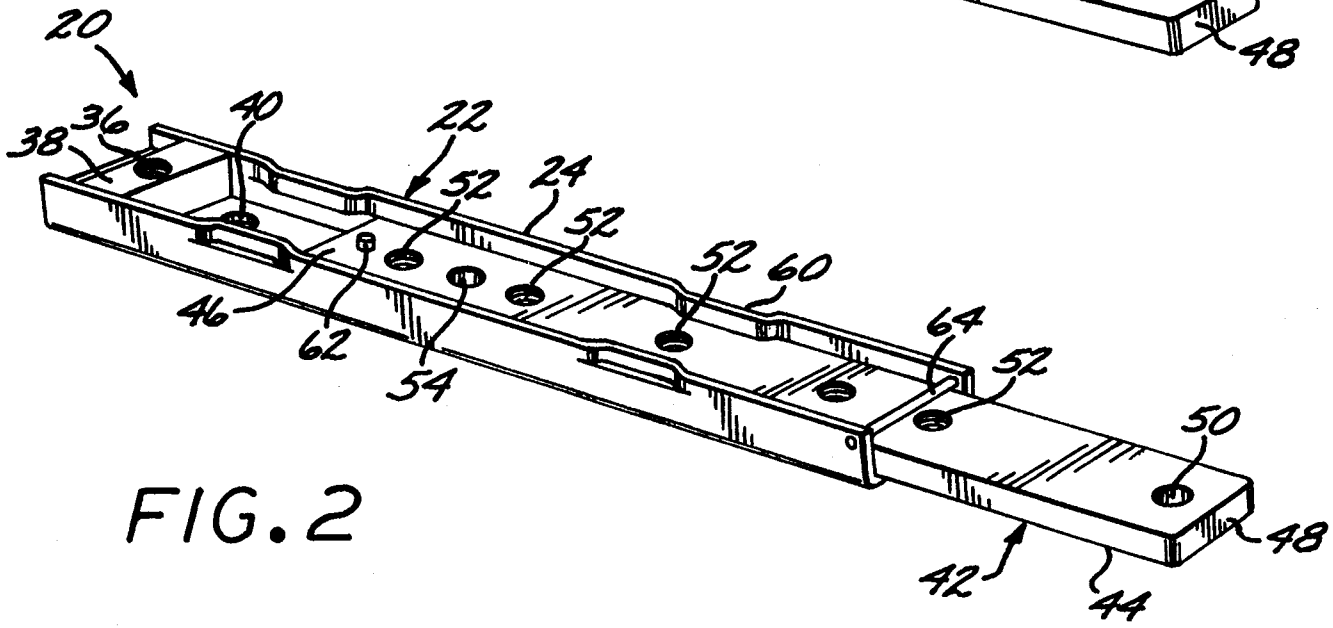
FIG. 2 is a bottom perspective view of the underframe pull clamp of FIG. 1.
Figure 3:
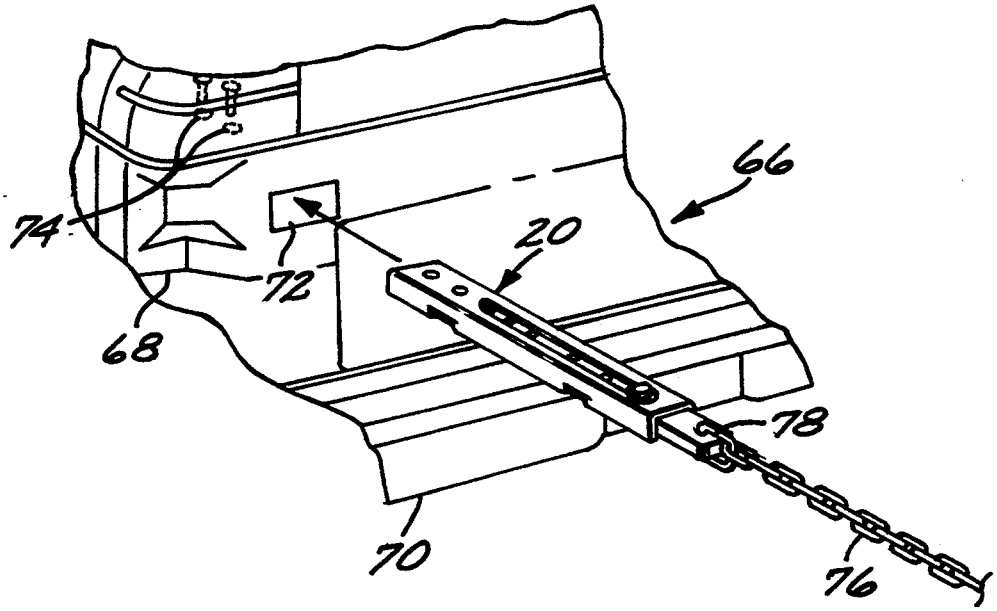
FIG. 3 is a perspective view of the attachment of the underframe pull clamp of FIG. 1 to an automobile underframe.

FIGS. 1–3 show a first embodiment of an auto body pull clamp 20, of particular value in straightening the body underframe of unibody vehicles. FIGS. 1 and 2 depict top and bottom perspective views of the pull clamp 20, differing only to the extent that FIG. 1 shows the frame attachment bolts and FIG. 2 does not. FIG. 3 illustrates its mode of attachment to an automobile underframe.

The pull clamp 20 includes an elongated channel member 22 having a U-shaped channel 24. In a preferred embodiment, the channel 24 is formed of ⅛ inch thick steel plate bent into a channel shape. The U-shaped channel 24 has a base leg 26 and two side legs 28 oriented at 90 degrees to the base leg 26, which together form the U shape. The base leg 26 has an elongated slot 30 therein, extending parallel to the direction of elongation of the channel member 22.

The channel member 22 may be described as having a first end 32 and a second end 34. A channel threaded hole 36 extends through the base leg 26 of the U-shaped channel 24, at a location adjacent to the first end 32, see FIG. 2. The threading is provided by welding an end block 38 into the channel 24 at the desired location of the threaded hole 36, and forming the hole and its threading through the base leg 26 and the end block 38. There may be additional holes 40, preferably unthreaded, at other locations through the base leg 26 along the length of the U-shaped channel 24.

An elongated sliding bar 42 is received into the channel 24 in a telescoping manner. The sliding bar 42 includes a bar body 44 which may be described as having a first end 46 and a second end 48. The first end 46 and the second end 48 of the bar body 44 lie adjacent to, but not necessarily in registry with, the respective first end 32 and second end 34 of the channel member 22, but become increasingly separated as the bar body 44 slides out of the channel member 22 in its telescoping fashion.

The bar body 44 includes a bar body bore 50 therethrough at a location adjacent to the second end 48. The bar body bore 50 is thus generally at the opposite end of the clamp 20 from the channel threaded hole 36. The bar body 44 also has at least one threaded hole 52 therethrough, adjacent to the first end 46 or at an intermediate position between the first end 46 and the second end 48. The threaded hole 52 of the bar body 44 is in registry with the slot 30 of the channel member 22. Optionally, there may be one or more additional threaded holes 52 in the bar body, also in registry with the slot 30. Optionally, there may be one or more unthreaded bores 54 through the bar body 44 in registry with the slot 30.

The clamp 20 has two or more frame attachment bolts 56 and 58. In the preferred use of the clamp 20, one of the bolts 56 is engaged through the frame of the automobile to the channel threaded hole 36 of the channel 24. The other of the bolts 58 is engaged through the frame of the automobile to one of the threaded holes 52 of the bar body 44.

The channel member 22 and the sliding bar 42 of the clamp 20 are manufactured as two separate pieces and then assembled together in the form shown in FIGS. 1 and 2. These two pieces can be assembled for each use, but the clamp 20 is more conveniently utilized if the two pieces are restrained to be held together with the sliding bar 42 engaged to the channel member 24, with only the sliding movement permitted. To retain the sliding bar 42 within the channel member 22, three retaining structures are provided. To hold the sliding bar 42 within the channel member 24, the side legs 28 of the U-shaped channel 24 are provided with at least two, and preferably four, indentations 60 that are bent inwardly. The dimension of the indentations 60 is selected so that the sliding bar 42 can slide in the space between the indentations 60 and the base leg 26, but not pop out of the U-shaped channel 24. The sliding bar 42 is constrained against sliding out of the end of the U-shaped channel 24 in one direction by the presence of the end block 38. The sliding bar 42 is constrained against sliding out of the end of the U-shaped channel 24 in the other direction by the contact between a post 62 set into the bar body 44 near its first end 46, and a bar 64 that extends between the side legs 28 of the U-shaped channel 24 at a location near its second end 34.

FIG. 3 illustrates the use of the clamp 20. An automobile 66 has an underframe 68 and a bumper 70. There is usually provided an opening 72 on the side of the underframe 68 to receive a pull clamp, or there may be direct access to the frame. The underframe 68 usually has at least two frame attachment holes 74 adjacent the opening 72 that are prepositioned by the manufacturer for use in frame straightening in the event of a later accident of the vehicle. These frame attachment holes 74 are not standardized, and are typically spaced and positioned differently for various makes and models of automobiles.

To use the pull clamp 20 in frame straightening, the clamp 20 is inserted through the hole 72 to a location adjacent to the frame attachment holes 74. The frame attachment bolt 56 is inserted through the frame hole furthest from the opening 72, and threaded into the channel threaded hole 36. The bar body 44 is telescopingly slid along the U-shaped channel until one of the threaded holes 52 aligns with the second frame attachment hole 74. The second frame attachment bolt 58 is inserted through the second frame attachment hole 74, through the slot 30 of the U-shaped channel 24, and threaded into the aligned threaded hole 52. The bolts 56 and 58 are tightened, thereby fixing the pull clamp 20 to the frame 68. This frictional engagement is usually sufficient to bear the required straightening loads. If not, one or more additional bolts can be engaged through the slot 30 to the other threaded holes 52 and tightened. The external force applying device (not shown) is attached to the pull clamp 20 using a chain 76 with a clevis 78 engaged to the bar body bore 50. The frame straightening is accomplished by pulling through the chain 76 and the pull clamp 20 to apply a force to the underframe 68.

Figure 6:
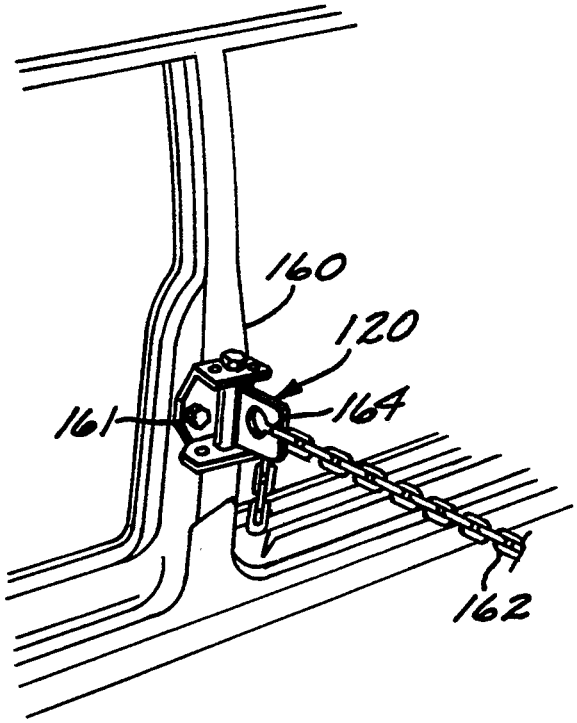
FIG. 6 is a perspective view of the attachment of the door hinge pillar pull clamp of FIG. 4 to an automobile door hinge pillar.
Figure 4:
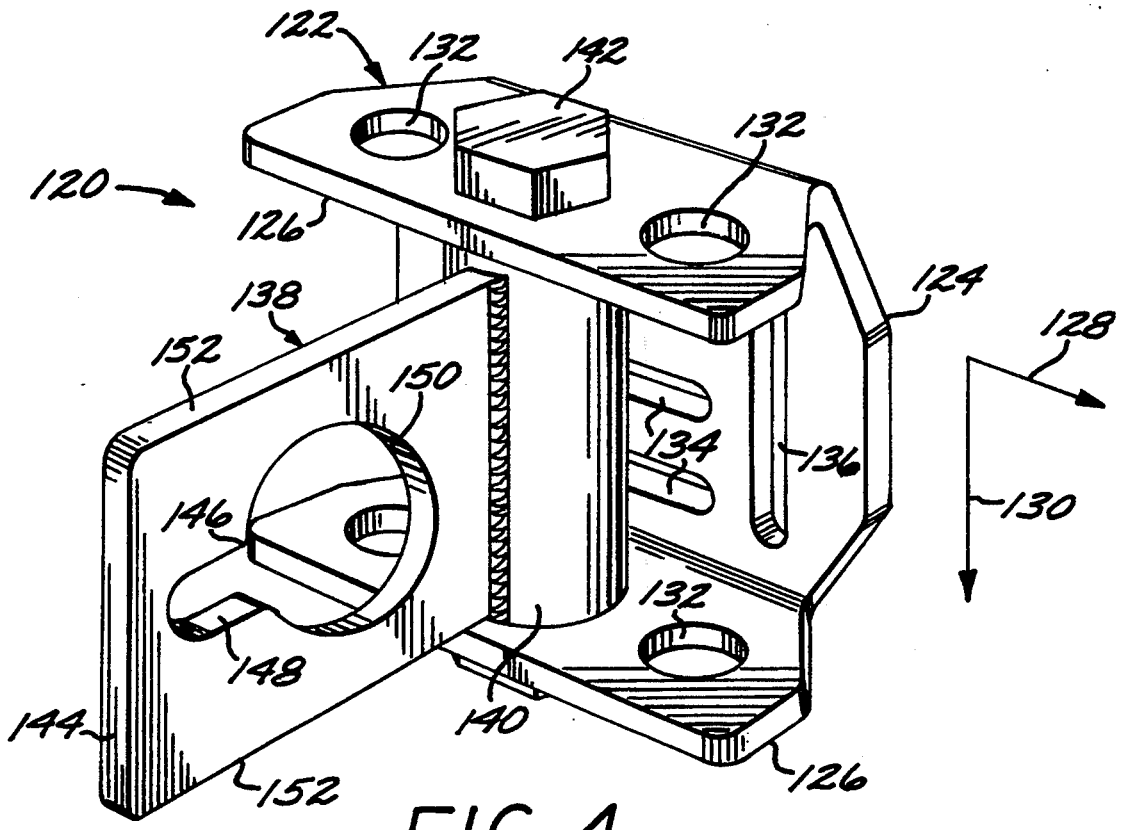
FIG. 4 is a perspective view of a door hinge pillar pull clamp, in a first use configuration.
Figure 5:
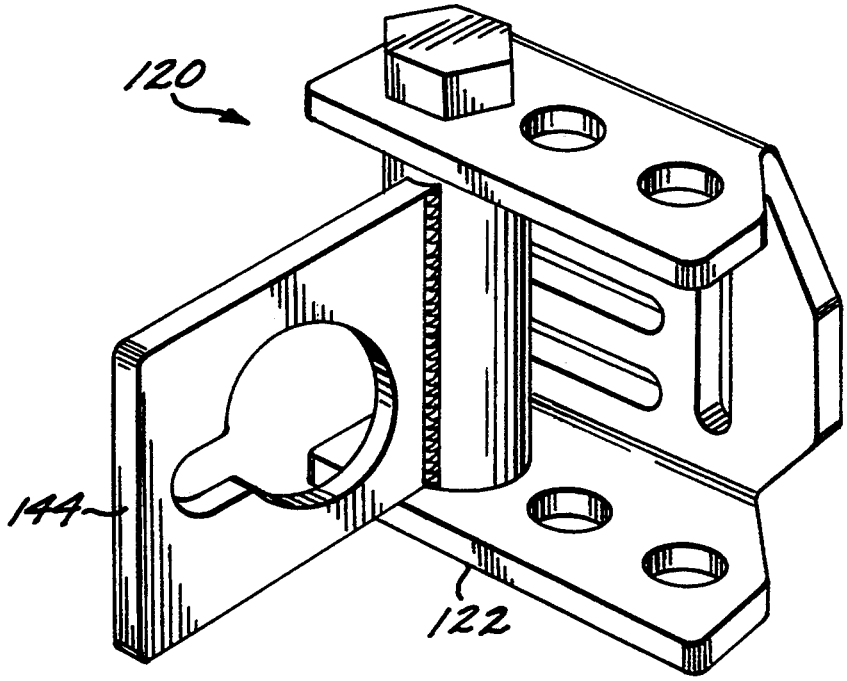
FIG. 5 is a perspective view of the embodiment of the door hinge pillar pull clamp of FIG. 4, in a second use configuration.

FIGS. 4 and 5 illustrate a pull clamp 120 of particular use in straightening automobile door frames. FIGS. 4 and 5 show the same pull clamp 120, assembled in two different arrangements to illustrate the variations available with the preferred approach. FIG. 6 shows the manner of use of the pull clamp 120. The problems encountered in straightening door frames are the different hole patterns found in the door frame pillars for attachment of the door hinges, and the need to pull in different directions and with different types of loadings. The pull clamp 120 solves both of these problems.

The pull clamp 120 has a U-shaped body 122 with a base leg 124 and two side legs 126 oriented at 90 degrees to the base leg 124. For subsequent reference, the base leg 124 may be described as having a longitudinal direction 128 in the plane of the base leg 124 and parallel to the side legs 126, and a transverse direction 130 in the plane of the base leg 124 and perpendicular to the side legs 126.

The side legs 126 have at least one pair of unthreaded pivot bores 132, with the individual bores in facing relation to each other across the "U" of the U-shaped body 122. In the preferred embodiment, there are three pairs of pivot bores 132.

The base leg 124 has at least one longitudinal slot 134 therethrough elongated parallel to the longitudinal direction 128, and at least one transverse slot 136 therethrough elongated parallel to the transverse direction 130. In the preferred embodiment, there are three longitudinal slots 134, with the uppermost one obscured in the drawing by the upper side leg 126. In the preferred embodiment, there are two transverse slots 136 at the opposing ends of the longitudinal slots, with the leftmost transverse slot 136 obscured in the drawing by other structure.

The pull clamp 120 further includes a pivoting member 138. The pivoting member 138 has a hollow cylindrical pivot portion 140 having a length that is less than the spacing between the side legs 126 of the U-shaped body 122. The pivoting member 138 can therefore fit between the side legs 126. An axle, preferably in the form of a bolt 142, fits through the pivot portion 140 and the two opposing pivot bores 132 of a pair to pivotably engage the pivoting member 138 to the U-shaped body 122. The use of a bolt 142 as the pivot axle is preferred to permit the pivoting member 138 to be moved between different pairs of the pivot bores 132 for various straightening applications, as will be discussed in more detail subsequently.

Affixed to the pivot portion 140 is a tongue member 144, which can be pivoted about the U-shaped body 122 by operating the pivot. The tongue member 144 has a slot 146 therein, oriented perpendicular to the cylindrical axis of the bolt 142, which is the axis of rotation of the tongue member 144. In a preferred form, the slot 146 is of a keyhole configuration with the larger end adjacent to the pivot portion 140. A first portion 148 of the length of the slot 146 is narrow, and a second portion 150 is radially enlarged to easily receive a clevis which slides into the first portion 148 after engagement.

The tongue member 144 has two edges 152, one adjacent to each of the side legs 126 when the tongue member 144 is pivoted to lie parallel to the base leg 124. In a preferred form of the invention, the slot 146 is asymmetrically located between the edges 152. That is, the slot is closer to one of the edges 152 than to the other of the edges 152. As will be discussed, this asymmetry gives yet another degree of pulling flexibility to the clamp 120.

The slots 134 and 136 of the U-shaped body 122 can be used together to provide nearly complete adaptability to any hole pattern of the door hinge pillar of an automobile. The pivot bores 132 are spaced upwardly from the base leg 124 by a sufficient distance to permit a bolt head to fit between the pivot portion 140 and the base leg 124. Any combination of longitudinal slots 134 and transverse slots 136 can be used to establish a bolted engagement to the hole pattern of the door hinge pillar. For example, a frame attachment bolt (not shown) might extend through one of the longitudinal slots 134 and another frame attachment bolt might extend through one of the transverse slots 136. The selection of which of the slots is to be used is one aspect of the determination of the nature of the pulling force applied to the door frame through the pull clamp 120 attached to the pillar.

Another aspect of the versatility of the pull clamp 120 is seen by comparing the views of FIGS. 4 and 5. The structures shown in these figures are identical, with two exceptions. In FIG. 4 the pivot portion 140 of the pivoting member 138 is pivotably attached to the U-shaped body 122 through the central pair of pivot bores 132. In FIG. 5, the pivot portion 140 of the pivoting member 138 is pivotably attached to the U-shaped body 122 through the leftmost pair of pivot bores 132. This movement applies the straightening force through a different force vector, and also permits the application of a straightening torque in addition to a linear force.

The second difference is that in FIG. 5 the tongue member 144 has been inverted by removing the bolt 142. The asymmetric slot 148 is therefore inverted to an "upward" orientation in FIG. 5, as compared with the "downward" orientation of FIG. 4. This change in the structure of the clamp 120 permits an end-for-end change to the straightening torque applied to the door frame, and also gives a further degree of freedom to the placement of the pulling force.

It must be kept in mind that the frame straightening process often requires working with highly distorted frames, particular the side-facing frames such as the door hinge pillars of the door frames. The ability to adjust the direction of pulling and modify the axial and torque forces is an important advantage of the present pull clamp, as well as the ability to engage varying hole patterns in the frame.

FIG. 6 depicts the manner of use of the pull clamp 120 to straighten a door hinge pillar 160 of an automobile. The hinge (not shown) attached to of the door hinge pillar is removed, and the U-shaped body 122 is affixed to the hole pattern of the door hinge pillar 160 using the slots 134 and 136 in the manner discussed. This affixing is usually performed with the bolt 142 removed and the tongue member 144 absent to permit good access to door hinge pillar attachment bolts 161.

After the U-shaped body 122 is affixed to the frame 160 and the bolts 161 tightened, the tongue member 144 is assembled to the U-shaped body 122 by placing the pivot portion 140 between the side legs 126, slipping the bolt 142 through one of the pair of pivot bores 132 and the pivot portion 140, and tightening a nut on the bolt. In assembling the tongue member 144 to the U-shaped body 122, care is taken to orient the tongue member 144 with the slot 146 in the desired upward or downward orientation. If, however, the frame straightener realizes after assembly that the orientation should be changed, or that a different pair of pivot bores 132 should be used, it is a simple, quick matter to remove the bolt 142, perform the necessary changes, and reassemble the clamp 120.

The pull clamps 20 and 120 have been constructed and utilized to straighten the frames of various makes and models of automobiles manufactured by different companies. The clamps have been found to provide previously unavailable flexibility in achieving attachment to various hole patterns in both the underframe and the door hinge pillar. The clamps are easy to use and to adjust quickly as needed.

Although particular embodiments of the invention have been described in detail for purposes of illustration, various modifications may be made without departing from the spirit and scope of the invention. Accordingly, the invention is not to be limited except as by the appended claims.

What is claimed is:

1. An auto frame pull clamp, comprising:
a first elongated member comprising
an elongated first member body,
a slot in the first member body extending parallel to the direction of elongation of the first member body, and
a threaded hole at a first end of the first member body;
a second elongated member comprising
an elongated second member body having a bore therethrough at one end thereof,
a threaded hole in the second elongated member, the threaded hole being in registry with the slot in the first member body, and
at least one bore through a second end of the second member body disposed oppositely to the first end of the first member body; and
means for retaining the first elongated member and the second elongated member in sliding contact.

2. The clamp of claim 1, wherein the first member body comprises a U-shaped channel and the second member body is a bar that fits within an interior of the U-shaped channel.

3. The clamp of claim 1, further including at least one additional threaded hole in the second member body, the at least one additional threaded hole being in registry with the slot in the first member body.

4. The clamp of claim 1, further including a bore through a first end of the second body member, the first end being oppositely disposed from the second end.

5. The clamp of claim 1, further including
a first bolt sized to engage the threaded hole of the first body member, and
a second bolt sized to engage the threaded hole of the second body member.

6. An auto frame pull clamp, comprising:
an elongated channel member comprising
a U-shaped channel having a base leg and two side legs, and a direction of elongation,
a slot in the base leg extending parallel to the direction of elongation of the channel, and
a channel threaded hole in the base leg adjacent a first end of the channel;
a sliding bar dimensioned to fit within the U-shaped channel and be slidable therein, the sliding bar comprising
a bar body,
a bar body bore through the bar body at a location adjacent a second end of the sliding bar remote from the first end of the U-shaped channel, and
a bar body threaded hole in the bar body, the bar body threaded hole being in registry with the slot in the base leg of the U-shaped channel; and
means for retaining the sliding bar within the U-shaped channel.

7. The clamp of claim 6, further including at least one additional threaded hole in the bar body, the at least one additional threaded hole being in registry with the slot in the U-shaped channel.

8. The clamp of claim 6, further including a bore through a first end of the bar body, the first end being oppositely disposed from the second end.

9. The clamp of claim 6, further including
a first bolt sized to engage the threaded hole of the first body member, and
a second bolt sized to engage the threaded hole of the second body member.

10. An auto frame pull clamp, comprising:
a U-shaped body having a base leg and two side legs, the base leg having a longitudinal direction parallel to the side legs and a transverse direction perpendicular to the side legs, the U-shaped body further comprising
at least one pair of pivot bores in the side legs, each pair of pivot bores including a facing pivot bore in each of the side legs,
at least one longitudinal slot in the base leg oriented parallel to the longitudinal direction, and
at least one transverse slot in the base leg oriented parallel to the transverse direction;
a pivoting member, comprising
a hollow cylindrical pivot having a length less than a spacing between the side legs of the U-shaped body, a tongue member joined to the cylindrical pivot, and a slot in the tongue member, the slot extending perpendicular to a cylindrical axis of the cylindrical pivot; and an axle sized to rotatably join the cylindrical pivot of the pivoting member to the U-shaped body by passing through the at least one pair of pivot bores.

11. The clamp of claim 10, further including at least one additional pair of pivot bores in the side legs, each additional pair of pivot bores including a facing pivot bore in each of the side legs.

12. The clamp of claim 10, further including at least one additional longitudinal slot in the base leg oriented parallel to the longitudinal direction.

13. The clamp of claim 10, further including at least one additional transverse slot in the base leg oriented parallel to the transverse direction.

14. The clamp of claim 10, wherein the slot in the pivoting member is of a keyhole form, having over a portion of its length a narrow slot region and over the remainder of its length an enlarged slot region.

15. The clamp of claim 10, wherein the pivoting member has a first edge adjacent to a first leg of the U-shaped body and a second edge adjacent to a second leg of the U-shaped body, and wherein the slot in the pivoting member lies parallel to the two edges but not at the same distance from each edge.

16. The clamp of claim 10, wherein the axle is a bolt.

* * * * *